United States Patent [19]

Boyesen

[11] Patent Number: 4,879,976

[45] Date of Patent: Nov. 14, 1989

[54] REED VALVE MECHANISM FOR ENGINES

[75] Inventor: Eyvind Boyesen, Kempton, Pa.

[73] Assignee: Performance Industries, Inc., Kempton, Pa.

[21] Appl. No.: 94,548

[22] Filed: Sep. 9, 1987

[51] Int. Cl.[4] ..... F02B 75/02

[52] U.S. Cl. ..... 123/651; 123/73 V; 137/855; 251/127

[58] Field of Search ..... 123/65 V, 73 A, 73 B, 123/73 V; 137/655; 251/127

[56] References Cited

U.S. PATENT DOCUMENTS

| | | | |
|---|---|---|---|
| 4,228,770 | 10/1980 | Boyesen | 123/73 V |
| 4,235,206 | 11/1980 | Boyesen | 123/73 V |
| 4,402,379 | 9/1983 | Hoshi | 180/225 |
| 4,474,145 | 10/1984 | Boyesen | 123/73 PP |
| 4,690,107 | 9/1987 | Emler et al. | 123/65 V |
| 4,712,520 | 12/1987 | Pasquin | 137/855 |
| 4,739,732 | 4/1988 | Nakamura | 123/73 V |

FOREIGN PATENT DOCUMENTS

| | | | |
|---|---|---|---|
| 0186676 | 11/1982 | Japan | 137/855 |

*Primary Examiner*—David A. Okonsky

*Attorney, Agent, or Firm*—Kenneth P. Synnestvedt

[57] ABSTRACT

Reed valve mechanism for use in the fuel/air supply system of an internal combustion engine, the mechanism including passages, ports and reed valves, all of which are arranged to minimize unnecessary fluctuations of the flow velocity of the fuel/air being delivered to and into the cylinder of an engine and also minimize localized turbulence in the flow path and thereby increase the power output of the engine.

17 Claims, 9 Drawing Sheets

REED VALVE MECHANISM FOR ENGINES

BACKGROUND AND STATEMENT OF OBJECTS

In my prior U.S. Pat. Nos. 4,228,770, issued Oct. 21, 1980, and 4,474,145 issued Oct. 2, 1984, there are disclosed various forms of fuel supply systems particularly adapted for use in internal combustion engines, especially two-cycle engines of the kind extensively employed in motorcycles and also in various industrial equipment, including power saws.

In many of such two-cycle engines, the fuel/air supply system includes a supply passage approaching the inlet opening in the cylinder wall, and further includes at least one ported wall positioned in a plane transverse to and usually obliquely inclined with respect to the axis of flow through the fuel/air supply passage. Quite commonly, a V-shaped reed cage is employed in such fuel supply systems, as is disclosed in my prior U.S. patents referred to above and also in the present application, the reed cage having a pair of inclined converging side walls joined in a reed cage apex presented downstream of the axis of flow through the supply passage. Reed valves are provided overlying the valve ports in the inclined ported walls. Although the reed cage may be positioned with its apex extended in various directions, it is preferred that the apex be generally horizontal as shown in various embodiments illustrated.

In fuel supply and valve arrangements of the kind referred to, in order to maintain maximum power output of the engine, especially at high operating speeds, it is of great importance to minimize fluctuations in the velocity of flow through the fuel/air supply system and through the valves and into the cylinder. Some appreciable reduction of fluctuations in the velocity of flow is provided in my prior U.S. patents above referred to by the provision of an interior element in the flow passage upstream of the valve ports, such element having an aerodynamic or airfoil contour so that velocity fluctuations in the fuel/air flow at and near the surfaces of the aeroform element are reduced, particularly at high engine speeds.

It is also of importance to minimize abrupt changes in the direction of flow of the fuel/air through the intake system and the valves and into the intake port of the engine, thereby minimizing fuel/air drag as the fuel/air flows through the intake system. Still further, it is of importance to avoid localized turbulence in various regions of the flow or supply passage.

The foregoing and other objectives of the present invention are accomplished by introducing a number of changes in the structure, contours and arrangements of the parts defining the flow passage at various regions along the flow path.

Some of the foregoing objectives are achieved by providing curvilinear surfaces surrounding the fuel/air flow passage or passages within the reed cage, such surrounding surfaces being of aerodynamic or airfoil contour within the reed cage and thereby minimizing flow velocity changes and providing for extensive reduction in turbulence at the perimeter of the flow passages within the reed cage as such passages merge with the portions of the port under the side edges and under the delivery end edge of the valve reed.

The passages through the reed cage are also arranged so as to avoid abrupt changes in the direction of flow within the reed cage.

As will further be seen, in certain embodiments of the present invention, provision is made not only for reducing the velocity fluctuations around the perimeter of the air/fuel flow stream, but this feature of the present invention may, in some embodiments, also be employed in combination with an aeroform element positioned within the passage in the reed cage similar to interior elements of the kind disclosed in my prior U.S. patents above identified, and this combination results not only in particularly effective reduction in velocity fluctuations but also in great reduction in turbulence.

Certain embodiments of the present invention further include a specially formed cavity in the engine housing for receiving the reed cage in the region of the inlet port through which the fuel/air is delivered from the reed cage. This cavity includes additional fuel/air passageways at the ends of the reed cage, formed in the engine housing structure beyond the end walls of the V-shaped reed cage. Such additional passages at each end of the reed cage generally parallel the adjacent inclined surface of the reed cage and are interconnected with a cavity or passageway formed in the engine housing structure beyond the reed cage apex and leading to the engine intake/porting. These additional external passages lie beyond each end of the reed cage and not only communicate with each other but also communicate with the fuel/air flow path downstream of the reed cage apex and thus also with the intake porting into the engine. All of these additional passages are preferably also of curvilinear contour in order to minimize abrupt changes in the flow path of the incoming fuel/air when the reed valves open the valve ports in the reed cage. In this way, portions of the fuel/air delivered from the valve ports at the end regions of the reed cage apex may spread laterally into passages of aeroform contour merging downstream of the apex and ultimately entering the intake porting in the engine housing structure.

The foregoing is particularly effective in minimizing the undesirable type of turbulence which frequently results from impingement of a fuel/air stream against a surface which is planar, rather than curvilinear.

In considering various aspects of the present invention, it should be kept in mind that in the operation of the engine at any speed, the flow of the fuel/air into the cylinder necessarily starts and stops with each cycle of the engine regardless of the speed of operation. However, the contours of the surfaces defining the flow passages extensively influence the character of the starts and stops of the flow. Flat surface areas perpendicular to the flow axis accentuate turbulence and unnecessarily increases kinetic energy loss when the flow starts and stops.

The flow passage arrangements provided according to the present invention are used in combination with certain valve porting and reed valve arrangements which also reduce turbulence and fluctuation of flow velocity in the flow path.

Unnecessary turbulence and secondary velocity fluctuations of the fuel/air flow tend to reduce the power output of the engine, in part, because of the waste of energy involved in unnecessary velocity changes. The fuel/air stream has kinetic energy, and increase or decrease of the flow velocity results in loss of kinetic energy, and at any speed of operation of the engine, unnecessary fluctuations of velocity results in substantial energy loss. Avoiding rapid fluctuations of the flow velocity also diminishes turbulence in areas where the flow path is required to shift in direction, and this further reduces waste of energy in engine operation.

BRIEF DESCRIPTION OF THE DRAWINGS

How the foregoing and other objects and advantages are attained will appear more fully from the following description of the drawings, in which:

FIGS. 1 to 5:

FIG. 1 is a perspective view of one side of a reed valve cage arranged according to this invention, portions of the reed valves being broken away in order to illustrate interior parts of the reed cage;

FIG. 2 is a cross-sectional view of portions of a two-cycle engine cylinder provided with a reed cage and valve arrangement of the kind shown in FIG. 1 and also illustrating a fuel/air supply connection;

FIG. 3 is a horizontal partial sectional view, certain portions of which are taken as indicated by the section line 3—3 on FIG. 2;

FIG. 4 is a view of the valve mechanism shown in FIGS. 1 to 3, but taken from the right of FIG. 3 looking toward the cylinder and omitting the fuel/air supply connection which appears in FIGS. 2 and 3; and FIG. 5 is a semi-schematic view illustrating the fuel/air flow path generated by the interior geometric contours of spaced transverse sectional views of the various parts of the reed cage, especially portions having curvilinear contours.

FIGS. 6 to 10:

FIG. 6 is a view of a second embodiment of the reed cage, the illustration of the reed cage being in perspective similar to the perspective of FIG. 1, but with the reed valves separated from the upper side of the reed cage in order to further illustrate details of the construction;

FIG. 7 is a view similar to FIG. 2 but illustrating the second embodiment;

FIG. 8 is a partial horizontal sectional view similar to FIG. 3 but illustrating parts in section, as taken along the line 8—8 of FIG. 7;

FIG. 9 is a view similar to FIG. 4 but illustrating the second embodiment in elevation; and FIG. 10 is a somewhat schematic or diagrammatic view similar to FIG. 5 but illustrating certain aspects of the flow passages provided in the second embodiment.

FIGS. 11 to 13:

FIG. 11 is a fragmentary view of a portion of the third embodiment, partly in section and partly in elevation, showing one end portion of the intake passage in the engine housing structure, with specially formed passages located beyond the ends of the reed valve cage, the reed valve cage being omitted in this view;

FIG. 12 is a view of the same structure as shown in FIG. 11 but further with a reed valve cage of the kind shown in FIGS. 7 to 10 inserted in the intake passage; and FIG. 13 is a view looking toward the apex of the V-shaped reed cage shown in FIG. 12, and further illustrating in cross section a portion of the engine housing structure surrounding the reed cage.

FIGS. 14 to 16:

FIG. 14 is a cross-sectional view similar to FIGS. 2 and 7, but omitting the piston and illustrating a fourth embodiment of an engine housing structure, the intake port and cavity for the valve reed cage in this embodiment being positioned to lie below the bottom dead center position of the piston;

FIG. 15 is a fragmentary view similar to FIG. 11, but illustrating the embodiment of FIG. 14 without the reed valve cage; and FIG. 16 is a view similar to FIG. 12, but showing the embodiment of FIGS. 14 and 15, and including the reed valve cage.

FIG. 17:

FIG. 17 is a graph as already described above.

DETAILED DESCRIPTION OF THE DRAWINGS

FIGS. 1 to 5

Figure 2:
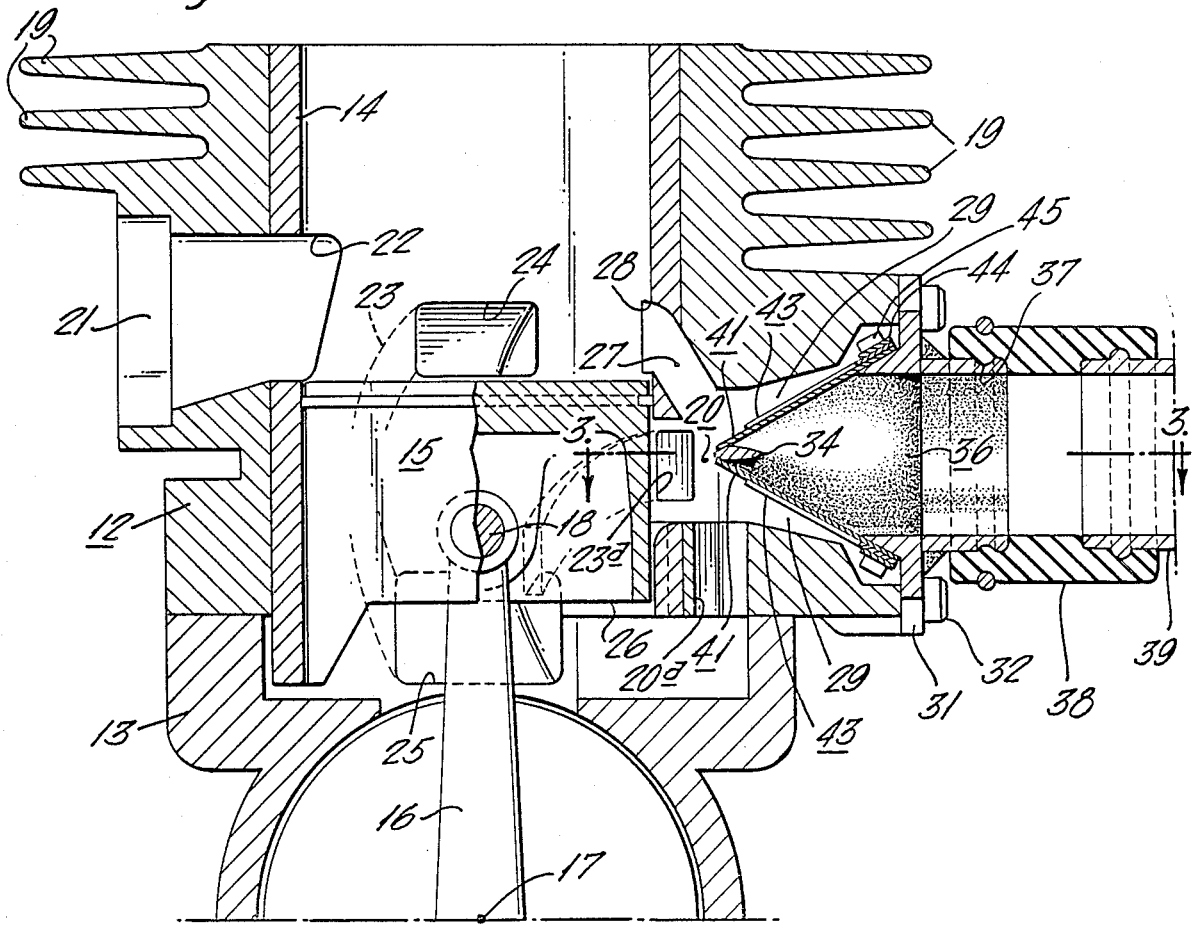
Figure 3:
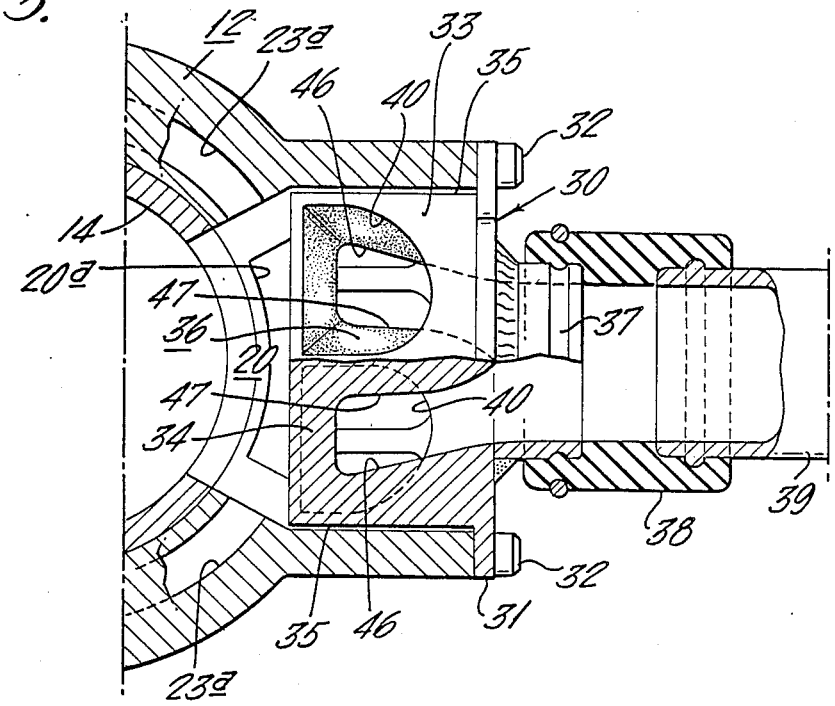
Figure 4:
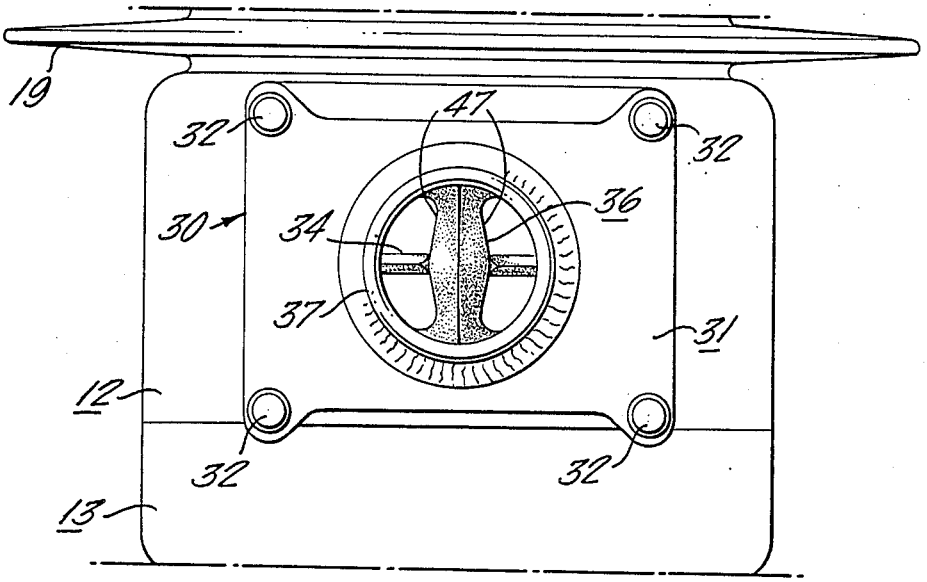

As best seen in FIGS. 2, 3 and 4, a typical engine housing or structure includes a cylinder casting 12 associated with a crankcase casting 13. The cylinder itself is defined by a cylinder liner 14 as is customarily employed and the piston 15 reciprocates in the cylindrical chamber formed within the cylinder liner 14. The piston has the usual connecting rod 16 projecting downwardly for association with a crank (not shown) on the crankshaft of the engine. The crankshaft (not shown) may be centered at the point indicated at 17. A counterweight of conventional form may also be associated with the crankshaft. The connecting rod is, of course, coupled with the piston by means of the wrist pin 18. Heat radiating fins 19 may also be provided externally of the cylinder.

A fuel/air intake passage or port is provided in the region 20 in the lower part of the side wall of the cylinder and extended intake porting 20*a* communicates with the space below the piston even in bottom dead center position. The fuel supply system delivers fuel/air to the porting 20 and 20*a* in the manner more fully explained hereinafter with reference to the valve mechanism provided according to the present invention.

An exhaust passage 21 is provided in a position generally diametrically opposite to the intake passage 20, this exhaust passage having an exhaust port 22 through the cylinder wall and cylinder liner and entering the combustion chamber above the piston when the piston is in bottom dead center position, which is the position illustrated in FIG. 2.

Primary transfer passages are also provided, one of which is indicated at 23, this passage having a transfer or delivery port 24 into the cylinder above the piston when the piston is in bottom dead center position, as in FIG. 2, and further having an entrance port 25 positioned to remain uncovered below the level of the piston skirt even when the piston is in bottom dead center position, as in FIG. 2. Supplemental passages, such as indicated at 23*a*, are also connected with the primary transfer passages 23 and are connected with the intake porting 20, as is shown in FIGS. 2 and 3. It should also be noted that the skirt of the piston is cut off at least in the area indicated at 26 so that even in bottom dead center position, the extended intake porting 20*a* remains open. When the piston rises in the cylinder sufficiently to uncover the port 20, communication is also provided from the fuel/air intake port 20 radially inwardly and downwardly into the space below the piston and the adjoining crankcase volume.

Because of the arrangements described above, when the piston 15 rises, the resultant suction or decrease in pressure in the crankcase region results in the drawing in of fuel/air through the intake port 20 and the extended porting 20*a* into the space below the piston. This suction continues until the piston substantially reaches its top dead center position. The top wall of the cylinder is not illustrated in the drawings, but its location and configuration are well understood in this art. The top wall is customarily located just above the top of the combustion chamber illustrated in FIG. 2, and the upward stroke of the piston brings the top of the piston substantially to the top of the cylinder structure shown in FIG. 2. When the piston rises in the cylinder, above the transfer port 24, the transfer passage 23 in the cylinder wall is closed. The exhaust passage 21 is also closed when the port 22 is covered by the piston.

When the piston descends, the charge of fuel/air which was introduced into the crankcase chamber or space below the piston during the preceding upward stroke of the piston is compressed in the space below the piston by the closing of the reed valves. This compression of the charge continues until the transfer port 24 at the upper end of the transfer passage 23 is opened by the descent of the piston, and at that time, the fuel/air compressed below the piston is delivered upwardly through the transfer passage 23 into the combustion chamber above the piston.

Each upward stroke of the piston compresses a charge of fuel/air in the combustion chamber above the piston head, and at the top of the stroke, as is customary and well known in this art, the compressed charge is ignited, with resultant explosion which drives the piston down again and also results in exhaust of products of combustion through the exhaust port 22 and the exhaust passage 21.

The embodiment illustrated in FIG. 2 also includes an auxiliary transfer passage 27 having a port 28 in the cylinder wall and interconnecting the fuel intake chamber 29 with the space above the piston.

The arrangement and functioning of the parts described above with reference to the two-cycle engine, including the cylinder, piston, intake chamber 29 with the intake port 20, and also with other parts pointed out including the main transfer passage 23, the supplemental passage 23*a*, the exhaust passage 21 and the auxiliary transfer passage 27, is well understood in the two-cycle engine art, including the two U.S. patents referred to herein.

The present invention is particularly concerned with a novel form of the intake valve mechanism or structure provided for introducing the fuel/air from a carburetor or other appropriate source into the intake chamber 29 and thus into the various ports and passages associated with the intake chamber and ultimately into the combustion chamber.

Figure 1:
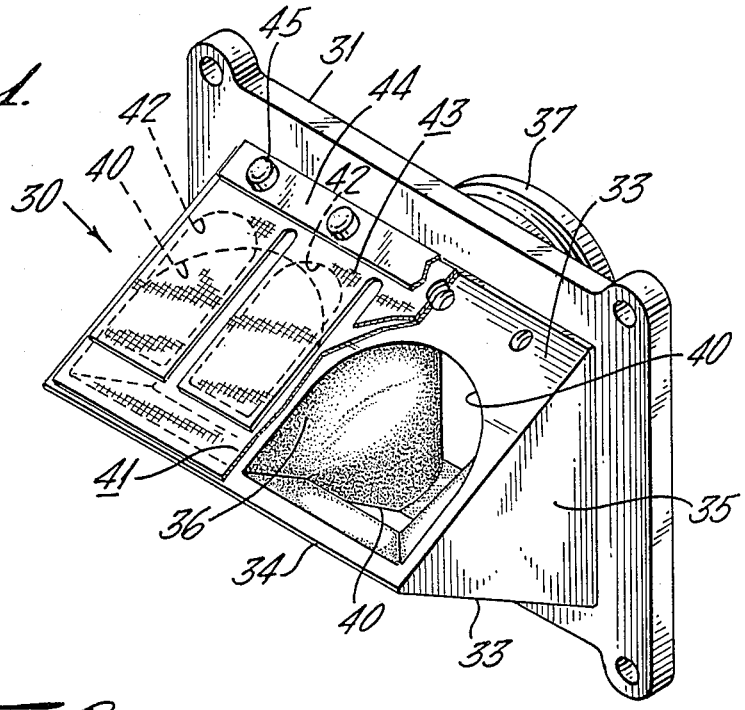
FIGS. 1 to 5 illustrate one embodiment.

In many prior art arrangements, the intake valve mechanism is associated with what is known as a reed cage, and the present invention provides a novel form of reed cage, this structure being shown in perspective in FIG. 1, and also shown in vertical section in FIG. 2. The reed cage appears in FIG. 3 partly in horizontal section and partly in elevation. The reed cage is generally indicated in FIG. 1 by the numeral 30, the reed cage having a mounting plate 31 adapted to be connected to the cylinder structure 12 by means of attachment screws 32. The body of the reed cage is of V-shaped configuration having a pair of obliquely inclined walls 33, meeting at an apex 34. The reed cage also has external end walls 35 and a central wall 36 dividing the space within the reed cage into two channels which merge or join at the upstream end in a common passage or duct 37. Fuel is adapted to be supplied into the common duct 37 through the fuel supply connection 38 adapted to be associated with the carburetor supply line 39.

From the above, it will be seen that the supply line from the carburetor extends into the interior of the V-shaped reed cage and is divided between the two interior channels formed at the sides of the central wall or partition 36.

The inclined walls 33 of the reed cage are each provided with a pair of primary valve ports 40 located at each side of the central wall or partition 36 (see particularly FIGS. 1 and 3). It will thus be understood that there are two ports 40 through each of the inclined reed cage walls at opposite sides of the reed cage.

The invention contemplates employment of flexible reed valves overlying the supply ports and in the preferred embodiment according to the invention, a single primary reed valve 41 is provided for the pair of intake ports 40 at each side of the reed cage.

The common primary reed valve 41 at each side of the reed cage is preferably provided with a plurality of secondary valve ports 42, two secondary ports being used in the embodiment of FIGS. 1 to 5; and a separate secondary reed valve 43 is provided for each one of the secondary ports 42. Each of the secondary reeds may be individually opened and closed under the action of the intake during operation of the engine. However, all four of the secondary reeds are preferably joined together at the base ends for convenience in manufacture and assembly. Moreover, both the primary and secondary reeds may be mounted in common at each inclined face of the reed cage by means of a fastening strip 44 connected to the reed cage by means of a series of attachment screws 45.

From FIGS. 1 and 2, it will also be seen that the attachment of the reed valves to the inclined reed cage walls is arranged along the base edges of the inclined walls of the reed cage.

The reed valves may be formed of a variety of materials, but preferably the reed valves are formed of resin material, the epoxy type of resins having glass fiber reinforcement being particularly effective for this purpose in two-cycle engines. The valve reeds preferably have a high modulus of elasticity and in a typical case, such as glass fiber reinforced epoxy resin, the resin should be heat-resistant up to about 350° F. and have a modulus of elasticity of the order of from 2,000,000 to 2,700,000.

In the preferred embodiment of the valve reeds, the primary valve reeds are preferably stiffer and thicker than the secondary reeds. Thus, the primary reeds may have a thickness of from about 0.018" to about 0.030", and the secondary reeds may have a thickness of from about 0.012" to about 0.020".

The secondary valve ports 42 and also the secondary valve reeds 43 are preferably respectively shorter than the primary ports 40 and the overlying portions of the primary valve reeds 41. In this way, the flow passage through the primary valve ports is larger than the flow passage through the overlying secondary valve ports. This relationship aids in establishing desirable relative timing of the opening and closing of the secondary and primary valve reeds at various speeds of engine operation.

The foregoing general arrangement of primary and secondary reeds contributes to efficient operation of the engine, particularly where, as is contemplated according to the present invention, the interior channels or passages through the reed cage to the primary reed ports are defined by side walls of curved or aeroform shape. Thus, the interior surfaces of the end walls of the reed cage defining portions of the flow channels or passages are of aeroform contour with respect to the axis of flow through the supply passage to the valve ports. The interior aeroform surfaces referred to are curved so as to lie closer to the flow axis in the upstream portion of the flow passage as compared with the downstream portion of the flow passage, as clearly appears in FIG. 3. These curved or aeroform surfaces appear in various figures and are identified by the reference numeral 46 in FIG. 3. Similarly contoured surfaces are provided at the opposite sides of the central wall or partition 36, such surfaces being identified by the numeral 47 in FIGS. 3 and 4.

The contours of the aeroform surfaces referred to provide for power increase of the engine at various speeds and various throttle settings. One of the reasons why these contours provide for an increase in the power output of the engine lies in the fact that the contours herein disclosed reduce unnecessary velocity changes and minimize turbulence and aerodynamic drag in the flow of the fuel/air entering the engine. The curvilinear shape of the walls defining the flow channels, particularly in the region of the downstream ends of the reed valves and the underlying ports results in improvement in power output because of extensive decrease in both aerodynamic drag and also localized turbulence in the flow path. This is especially true under the lower or free edges of the reed valves, and the laterally adjoining surfaces of the valve ports, because these are the regions where the highest velocity flow occurs in the flow through the valve mechanism. The power output of the engine is substantially increased under various operating conditions, as a result of these arrangements.

From FIGS. 1 and 2 it will also be noted that the apex member 34 of the reed cage is also of aeroform crosssectional shape, and this is of particular significance in the power output of the engine at high engine speeds. The aeroform cross-sectional shape of the apex member provides curved surfaces presented toward both sides of the reed cage, and these curved surfaces minimize local turbulence in the zones where the fuel/air flow is passing from the flow channels within the reed cage over the surfaces of the apex member and into the intake port 20.

Figure 5:
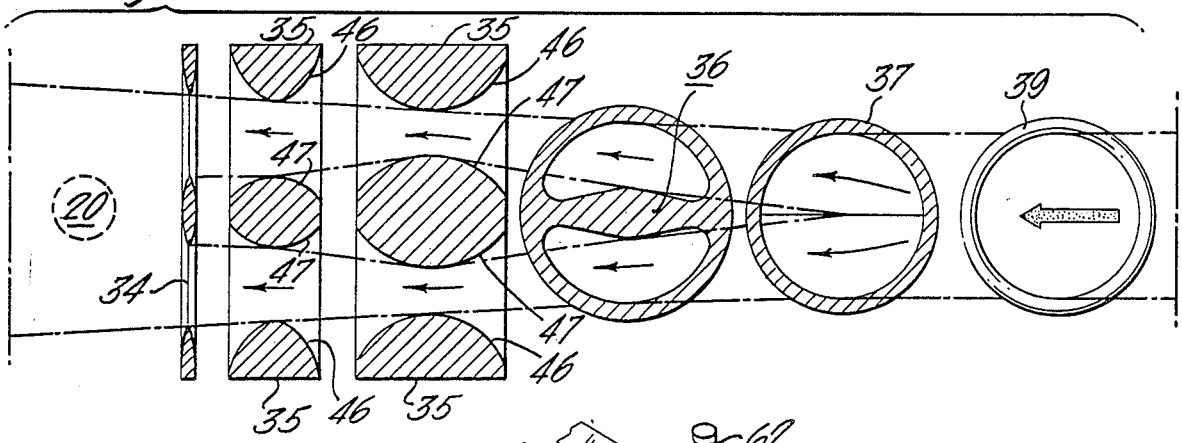

The somewhat schematic illustration of FIG. 5 serves also to indicate the minimization of turbulence occurring in the input of fuel/air in a system according to the present invention From FIG. 5, it will be seen that the sectional area of the flow channels does not abruptly change as the flow progresses from the carburetor supply line 39 to the intake port 20 The curvilinear surfaces indicated in FIG. 5 are also of effect in minimizing changes in the cross section of the flow passages and in minimizing aerodynamic drag, particularly in the downstream region of the flow path from which the fuel is delivered from the open reed valves into the intake port 20 of the engine.

FIGS. 6 to 10

Figure 7:
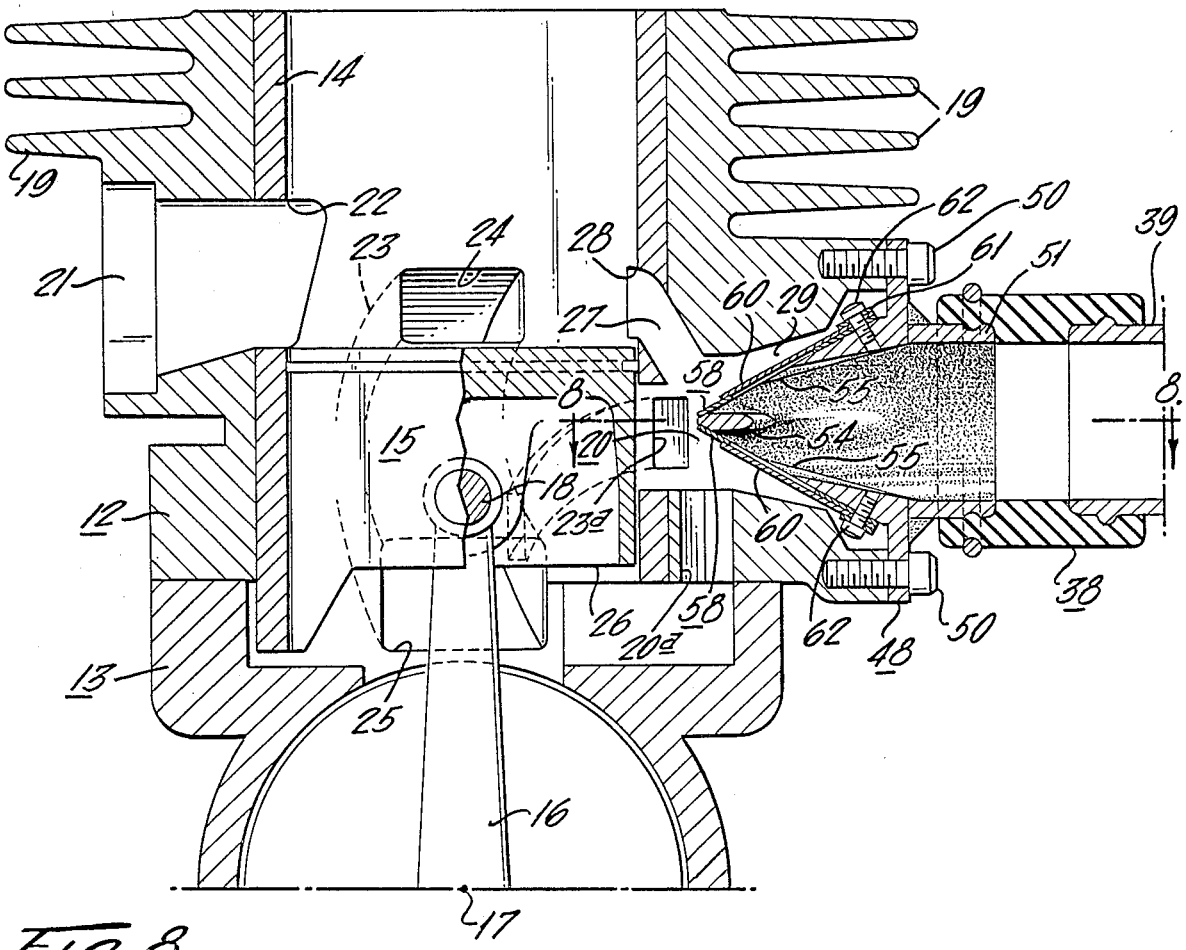
Figure 8:
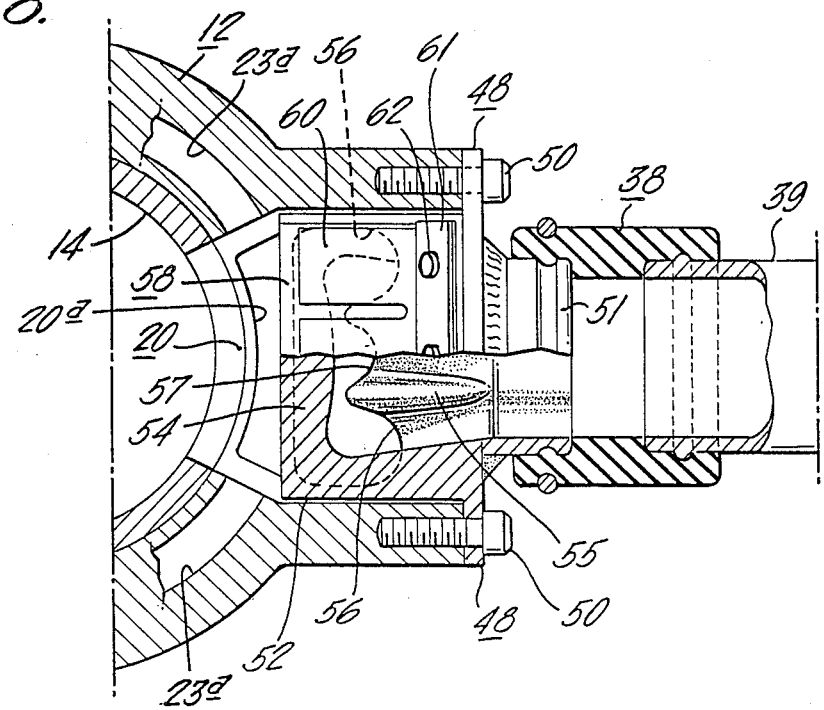
Figure 9:
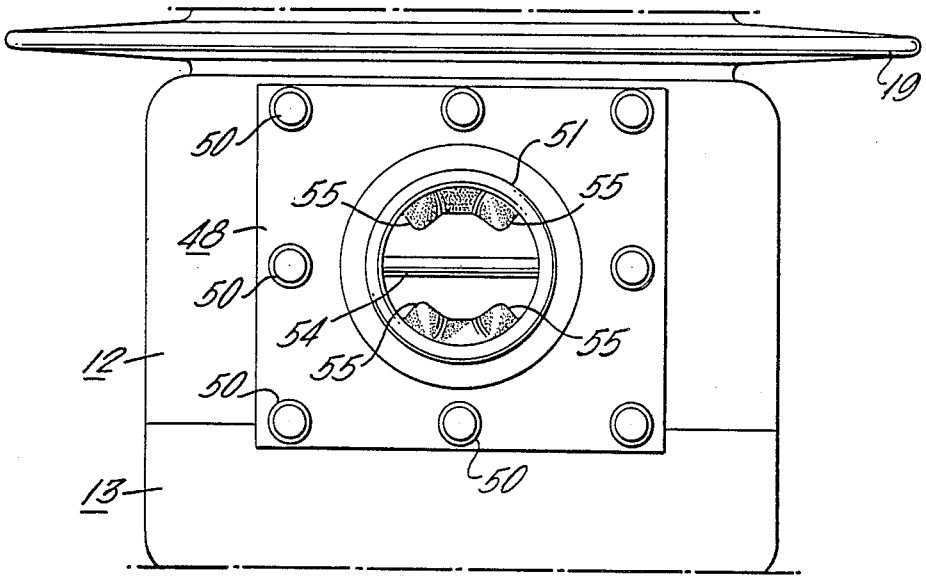

In the second embodiment illustrated in these figures, the general arrangement of the engine itself is the same as in the first embodiment, and the reference characters used to identify the various engine, cylinder and piston parts have been applied to FIGS. 7, 8 and 9 in the same manner as in FIGS. 2, 3 and 4. Repetition of these portions of the description is not necessary in view of the description above in connection with the first embodiment.

In the second embodiment, the arrangement and contours of the reed cage and the reed valve is different from the first embodiment, but in the second embodiment, as in the first embodiment, provision has been made for the employment of aeroform or curvilinear surfaces in various passages in order to reduce kinetic energy losses encountered in prior art arrangements and also in order to minimize localized turbulence and aerodynamic drag, both of these factors being of importance in maximizing the power output of the engine The reed cage as shown in the second embodiment includes a base or mounting plate 48 having apertures 49 for receiving fastening screws 50 by which the reed cage and valve assembly is mounted at the side of the engine cylinder 12.

As in the first embodiment, the reed cage is provided with a supply duct 51 adapted to be associated with the supply line 39 by means of the connection 38.

As in the reed cage of the first embodiment, the reed cage of the second embodiment is also formed with external end walls 52 and with a pair of obliquely inclined side walls 53 which are connected with the base plate 48 and which are joined at the reed cage apex by means of an apex member 54, thereby forming a V-shaped reed cage.

The interior of the reed cage is formed with curved surfaces 55 which provide three side-by-side interconnected flow channels at the inner side of each of the inclined walls 53 as those walls approach the apex 54. This distinguishes from the first embodiment in which the interior of the reed cage is divided into two separated channels, as above fully described. In the second embodiment, the interior partially separated channels terminate in three partially separated primary valve port areas as clearly appears toward the bottom of FIG. 6, the outer two of which are identified by the reference numeral 56 and the central one of which is identified by the numeral 57 (see particularly FIGS. 6 and 8). As will be understood from the drawings, this multi-channel arrangement is provided at both sides of the reed cage, interiorly of the two inclined walls 53.

Figure 6:
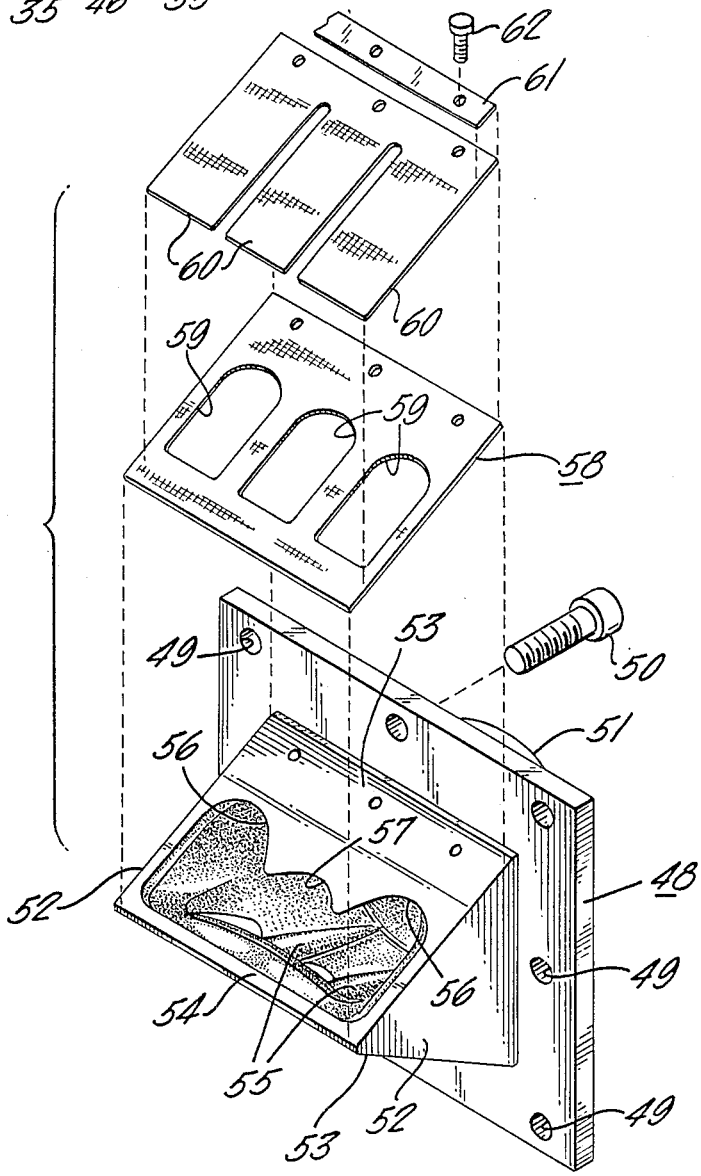
FIGS. 6 to 10 illustrate a second embodiment.

As in the first embodiment, the second embodiment is provided with both primary and secondary reed valves and these may be formed of the same type of materials as described above, but the arrangement is somewhat different because of the differences in the portage of the reed cage. While the reed cage of FIG. 6 is illustrated in the same perspective position as the reed cage in FIG. 1, the reed valves in FIG. 1 are illustrated (in part broken away) in positions as applied to the inclined walls of the reed cage, whereas in FIG. 6 the reed valves are shown in "exploded" relation to the reed cage.

The reed valves of the second embodiment include a primary reed valve structure 58 having three secondary valve ports 59 therein. The secondary reeds cooperating with the secondary ports 59 are indicated at 60, the secondary reeds being interconnected at the base or mounting ends and both the primary and the secondary reeds being adapted to be fastened to the reed cage, preferably by means of a common mounting strip 61 and mounting screws 62.

From the drawings, it will be clear that when these reed valves 58 and 60 are assembled and mounted upon the inclined walls of the reed cage, the primary reed valve structure 58 will overlie the primary ports 56-56 and 57, with the secondary valve ports 59 respectively positioned in alignment with the primary ports 56-56 and 57.

As in the first embodiment, it is contemplated that the secondary valves 60 should be thinner and more flexible than the primary reed structure 58.

Figure 10:
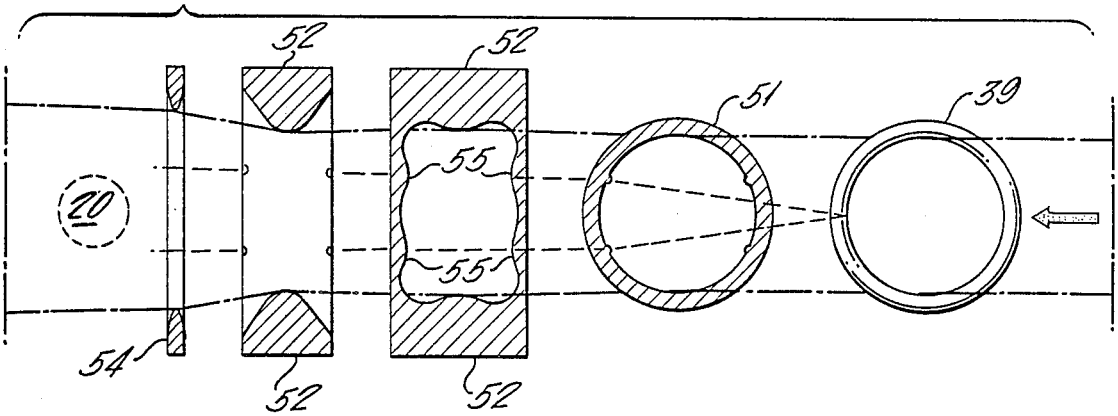

FIG. 10 is a semi-schematic view of the flow pattern in the second embodiment, shown in the general manner of FIG. 5 in relation to the first embodiment. Here also, it will be observed that the fluctuation in cross-sectional flow area and direction is minimized, thereby reducing aerodynamic drag.

Figure 11:
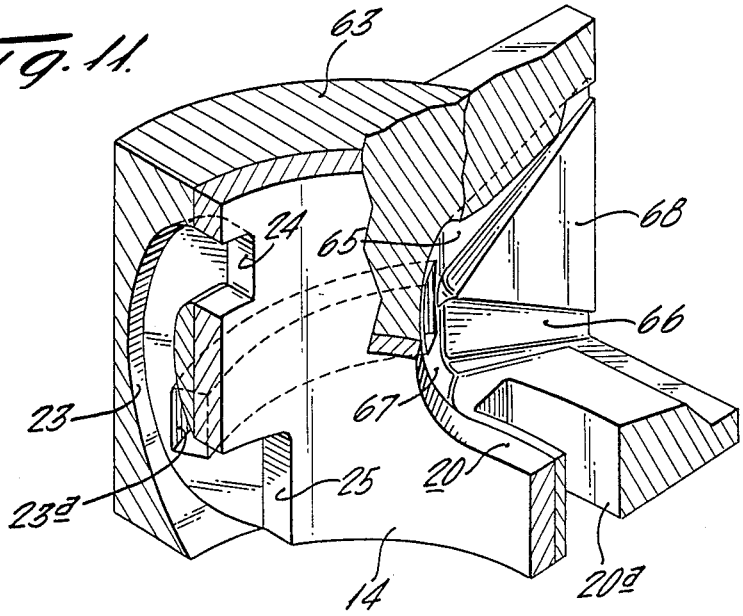
FIGS. 11 to 13 illustrate a third embodiment.
Figure 12:
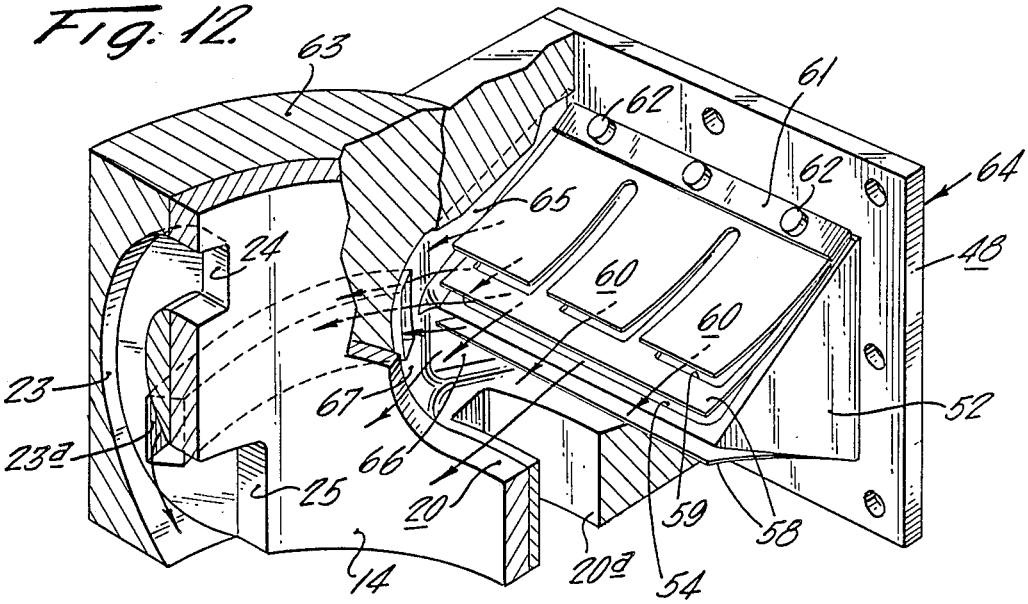
Figure 13:
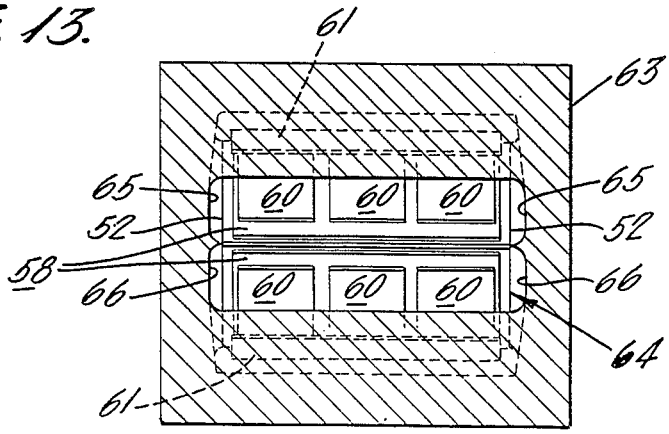

FIGS. 11 to 13

In considering the embodiment of FIGS. 11 to 13, it is first pointed out that the reed cage and reed valves which appear in FIGS. 12 and 13 are of exactly the same construction as the reed cage shown in FIGS. 6 to 10, and some of the reference numerals applied to the reed cage in FIGS. 6 to 10 have also been applied to FIGS. 12 and 13.

It should also be noted that in the embodiment of FIGS. 11–13, the primary intake port in the cylinder wall is again indicated at 20, and the extended intake porting is again indicated at 20*a*.

However, in the embodiment of FIGS. 11, 12 and 13, some additional intake flow passages are illustrated. Thus, the engine housing structure 63 outside of the cylinder liner 14 and in the region outboard of each end of the reed cage (the reed cage being generally indicated in FIG. 12 at 64) is provided with cavities 65 and 66 with curvilinear surfaces forming flow channels having axes generally paralleling the converging surfaces of the reed cage, these cavities being readily discerned in FIG. 11 in which the reed cage does not appear. The two flow channels 65 and 66 formed in the engine housing structure beyond each end of the reed cage are interconnected with each other in the region 67; and this junction of the passages 65 and 66 is connected with the intake port 20 and, thus, also to the extended intake porting 20*a* and with other passages mentioned below.

In FIGS. 11 and 12, it will also be seen that one of the primary transfer passages 23 is shown, this passage having a port 24 into the cylinder above the piston in bottom dead center position, and an inlet port 25 in the engine housing structure below the piston, the port 25 being positioned below the piston even in bottom dead center position. This type of primary transfer passage is preferably employed at both sides of the cylinder and is referred to above in connection with the embodiments of FIGS. 1–5 and 6–10.

Although it does not appear in FIGS. 11 to 13, it is contemplated that this embodiment also be provided with an auxiliary transfer passage, such as shown at 27 in FIGS. 2 and 7.

The embodiment shown in FIGS. 11 and 12 also includes the passage referred to as a supplemental passage, this supplemental passage being identified by the reference numeral 23*a* in FIGS. 11 and 12, the reference numeral here being applied toward the end of the supplemental passage adjacent to the primary transfer passage 23. As in the embodiments of FIGS. 1–5 and 6–10, this supplemental passage has communication with the intake chamber at the side toward the reed valve cage, the supplemental passage being extended from that area for communication with the space below the piston in the region of the lower end of the primary transfer passage 23. This supplemental passage may communicate with either the primary transfer passage 23 itself or with the crankcase spaced in the region of the inlet port 25 provided at the lower end of the primary transfer passage 23.

From FIGS. 11 and 12, it will be seen that the upper and outer end of the supplemental passage communicates with the intake chamber in the region indicated at 67, thereby providing for intercommunication between the supplemental passage 23*a*, the flow channels 65 and 66 and the intake region of the primary intake port 20 and the extended intake porting 20*a*.

From examination of FIGS. 11, 12 and 13, it will be seen that the engine housing structure has a triangular wall or surface 68 lying adjacent to the adjoining triangular end wall of the reed cage, this wall or surface 68 being congruent with the adjoining end wall 52 of the reed cage. In this way, the passages 65 and 66 in the engine housing structure at each end of the reed cage provide curvilinear flow channels for receiving fuel from both the primary and the secondary valve ports in regions at the ends of the reed cage, such flow being indicated by flow arrows applied to FIG. 12. From the flow arrows, it will be seen that the flow not only extends downstream to the intake port in the region 67, but further that the flow extends laterally under the side edges of the valve reeds and into the cavities 65 and 66 and also into the supplemental passage 23*a*.

The use of the supplemental passages 23*a* in combination with the cavities 65 and 66 is of particular advantage and importance in the configurations of the reed cages disclosed in this application because the interior surfaces of the end walls of the reed cage are curved and provide effective flow not only in the downstream direction over the reed cage apex, but also laterally over the end edges of the inclined walls of the reed cage. In effect, in all embodiments herein disclosed, the interior curved surfaces of the flow channels in the reed cage include curvilinear laterally bevelled edges adjacent to the side edges of the valve ports in order to minimize flow velocity fluctuations in the lateral flow from the valve port under the side edges of the valve reeds and, thus, into the adjoining intake cavities formed in the engine housing structure. This is also of importance in minimizing turbulence. This type of laterally curved or bevelled edges along the side edges of the ports within the reed cage just inside of the valve reeds is desirable in all of the embodiments herein disclosed but is of particular significance in the embodiment of FIGS. 11–13 (and also in the embodiment of FIGS. 14, 15 and 16, described herebelow), in which the lateral flow under the side edges of the valve reeds delivers fuel/air not only to the principal intake port area, but also to the cavities 65 and 66 and still further to the inlet end of the supplemental passage 23*a*, as particularly shown in FIG. 12.

The passages 65 and 66 described above may be cast or otherwise formed in the engine housing structure as a whole, or may be provided in inserts adapted to be assembled with the reed cage being inserted into the cavity provided to receive the reed cage.

The additional curvilinear flow channels 65 and 66 may be employed in any of the embodiments disclosed in this application, and these channels provide significant improvement in relation to efficient engine operation. Fluctuation in flow velocity is diminished, with consequent avoidance of unnecessary kinetic energy loss. Turbulence and aerodynamic drag at the corners of the reed cage apex are also greatly diminished.

Figure 14:
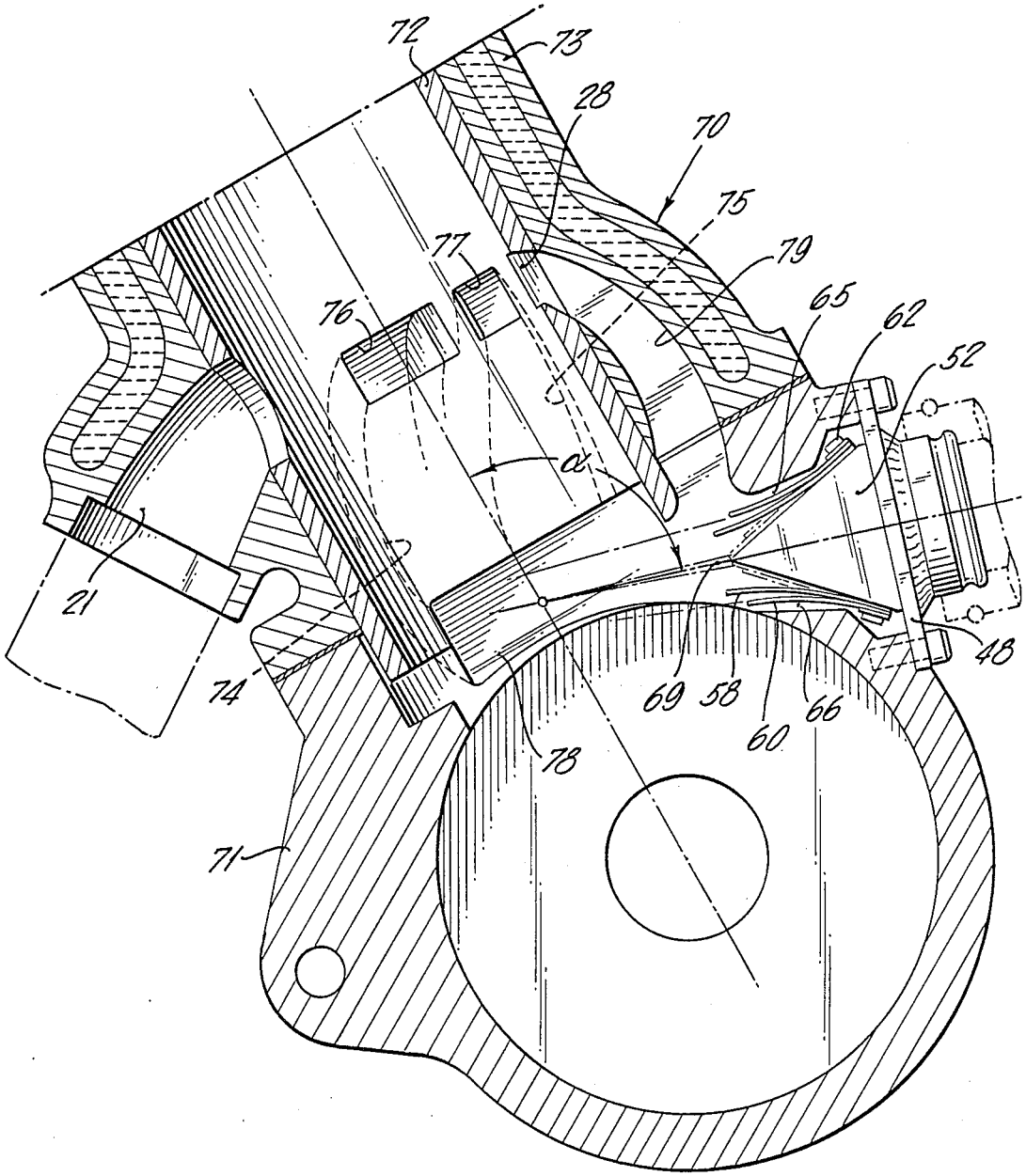
FIGS. 14 to 16 illustrate a fourth embodiment.
Figure 15:
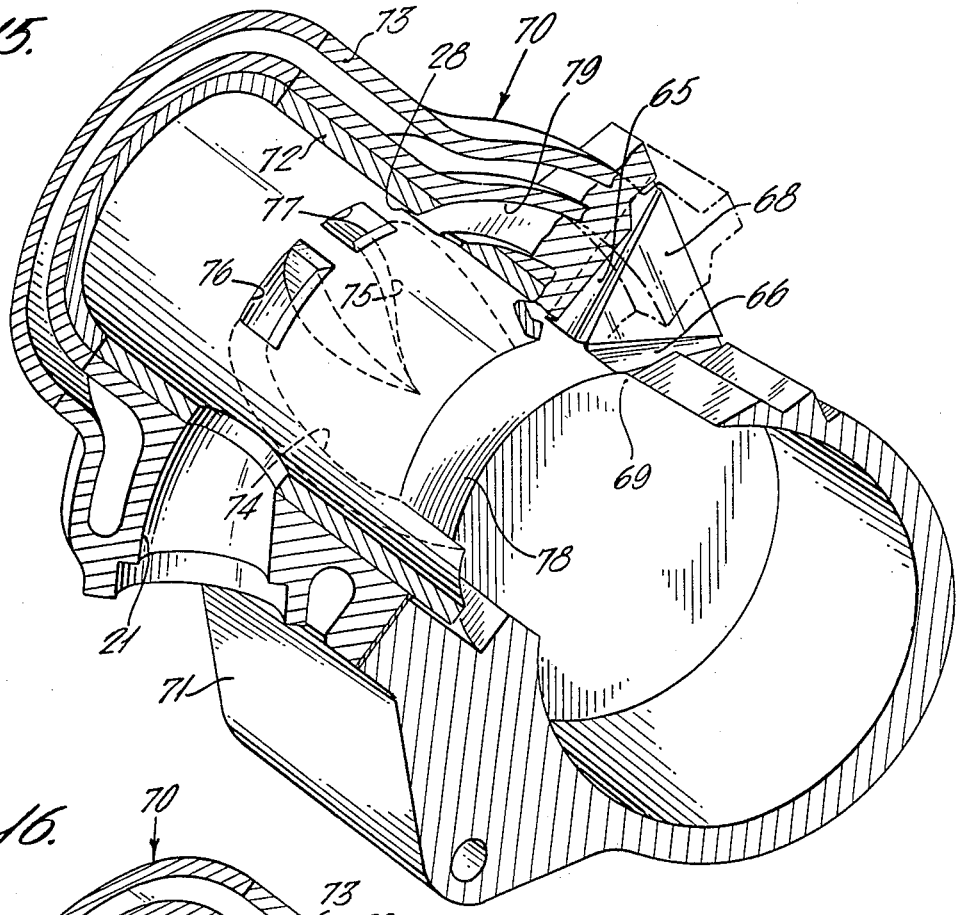
Figure 16:
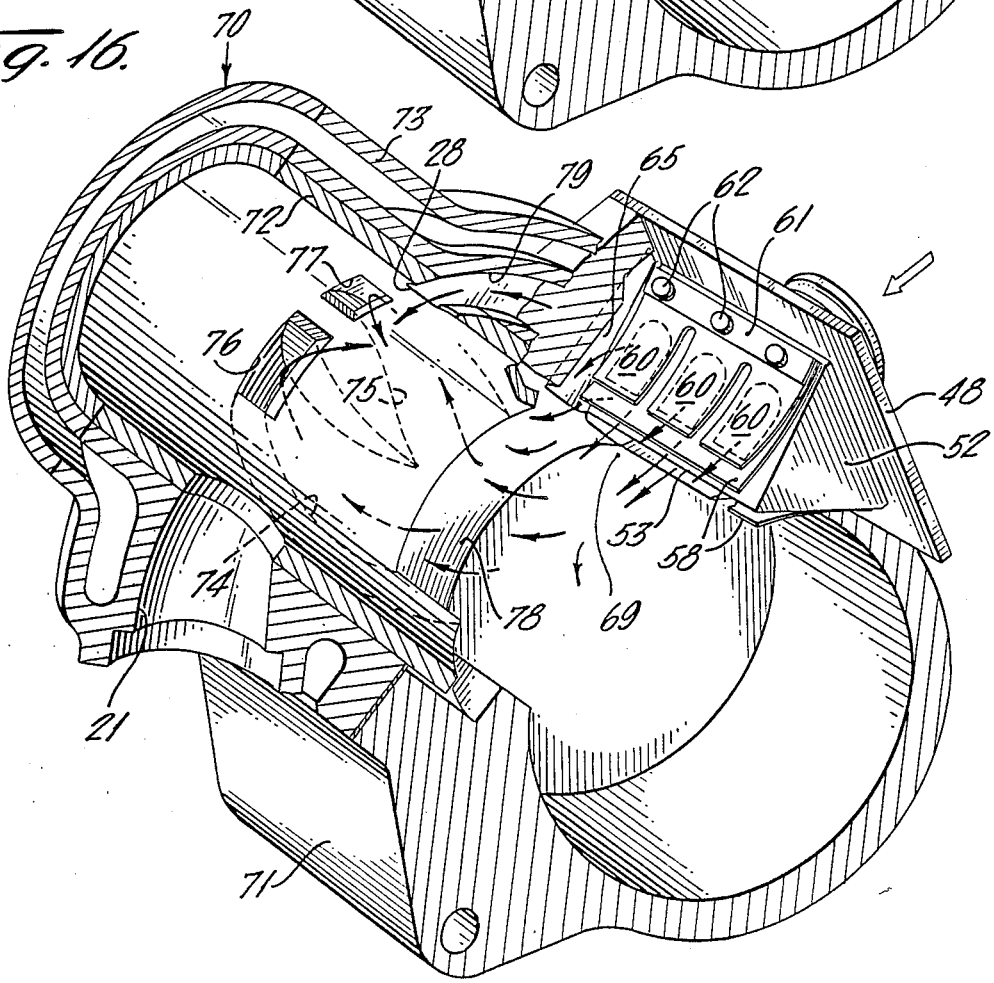

FIGS. 14 to 16

FIGS. 14 to 16 illustrate the use of certain features of the present invention in still another embodiment of two-cycle engines. In this embodiment, as in the embodiment of FIGS. 11 to 13, the arrangement of the reed cage conforms with the reed cage shown in FIG. 6 and also as described in connection with the embodiment of FIGS. 6 to 10, but the reed cage is used in a different position in the engine housing structure, as compared with the embodiment of FIGS. 6 to 10. In FIGS. 14 to 16, the engine housing structure is provided with an intake passage 69 below the lower end of the cylinder, which is indicated generally at 70. The intake passage 69 is actually formed in the crankcase casting 71, the cylinder casting being connected with the crankcase above the position of the intake passage 69. The cylinder includes a liner 72, and in this instance, is also provided with a water cooling jacket 73. Main transfer passages 74 and 75 are also provided, each of these passages having a separate delivery port, as indicated at 76 and 77, but at each side of the cylinder, the two transfer passages 74 and 75 are provided with a common entrance port 78 which may be formed, in part, in the crankcase casting 71.

In FIGS. 14, 15 and 16, it will be seen that the reed cage structure includes the various components as fully described above with particular reference to FIGS. 6, 7 and 8, and also with reference to FIGS. 11, 12 and 13.

Figure 17:
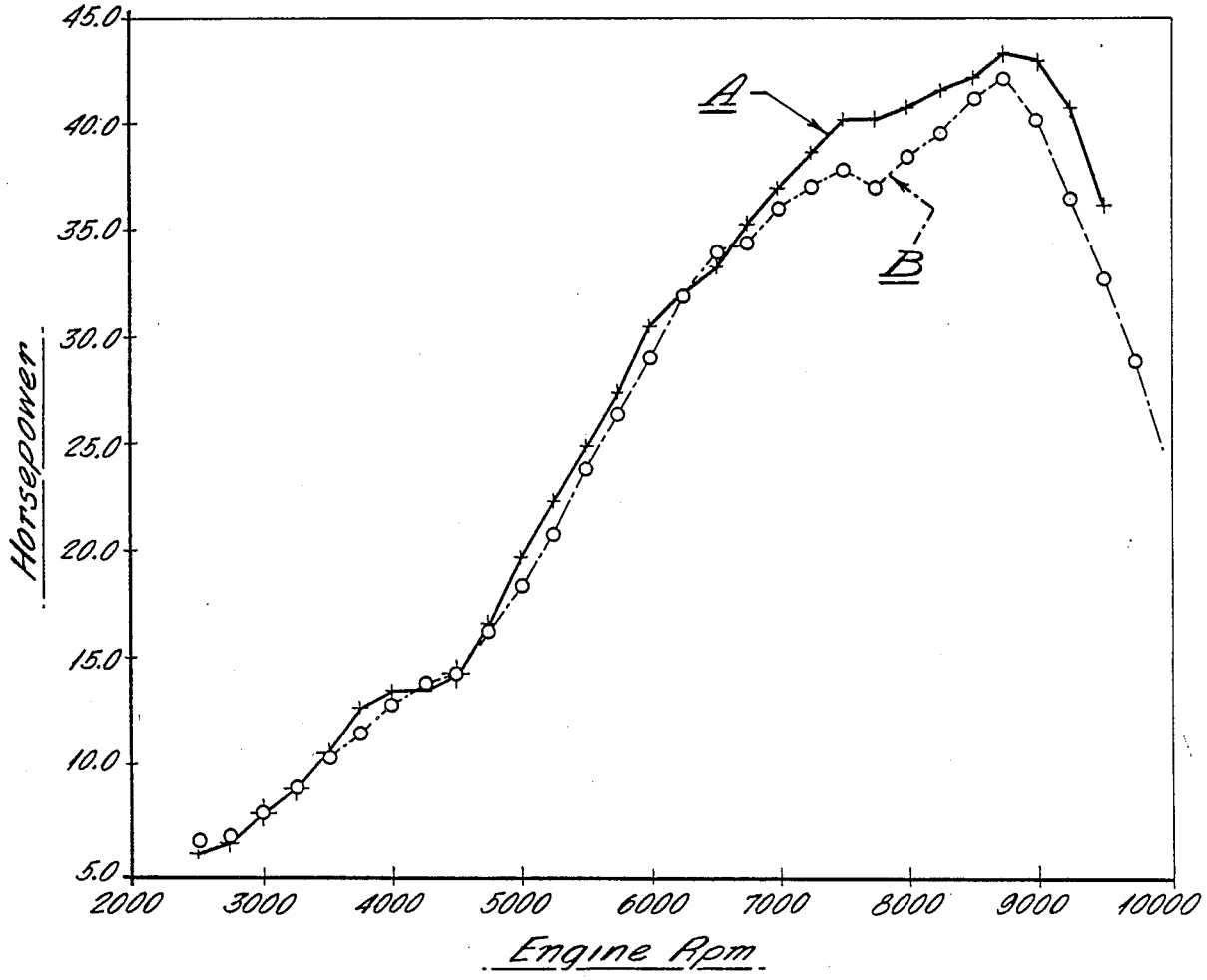
FIG. 17 is a graph illustrating power improvement of an arrangement according to the second embodiment of the present invention as compared with a prior art arrangement.

It will further be seen, especially from FIGS. 16 and 17, that the entrance port in which the reed cage is positioned is located so that the reed cage apex is directed downstream of the intake passage at a level in the region of the inlet ports of the transfer passages.

In this fourth embodiment, an auxiliary transfer passage 79 is also provided, the lower end being in communication with the intake passage 69, and the upper end having a port into the cylinder, such as indicated at 28 in FIGS. 2 and 7. The embodiment of FIGS. 14 to 16, however, is not provided with a supplemental passage, such as indicated at **23*a* in FIGS. 11 and 12, but desirably includes the curved converging passages 65 and 66, which are particularly shown in FIG. 15, these passages being arranged beyond the end walls of the reed cage in the same general manner as fully explained above with reference to FIGS. 11 and 12**.

Particular attention is directed to FIG. 16 in which flow arrows clearly indicate the fuel/air lines of flow. Thus, the flow arrows show the flow from both the primary and secondary ports of the reed valve cage in substantially direct or straight line flow to and into the intake chamber immediately adjoining various of the transfer passages, including both the principal transfer passages 74 and 75, and also the auxiliary transfer passage 79. From FIG. 16, it will be seen that these flow arrows not only extend from the region of the reed cage apex, but also laterally at the ends of the reed cage in the region of the curvilinear laterally bevelled edges adjacent the ends of the reed cage and thus into the converging passages 65 and 66. This is particularly effective for delivery of fuel/air from the end regions of the reed cage into the central intake chamber communicating with the various transfer passages.

The embodiment of FIGS. 14, 15 and 16 thus provides highly effective fuel entrance both from the standpoint of avoiding energy loss by reducing variations in velocity and also from the standpoint of minimizing turbulence.

FIG. 17

Curve A of FIG. 17 shows a computer-operated dynamometer test of an engine equipped with a valve arrangement as shown in FIGS. 6 to 10, and curve B shows a corresponding test of the same engine, but equipped with standard reed valve mechanism having a V-shaped reed cage without the aeroform surfaces provided by the present invention.

In FIG. 17, the comparative curves represent the power output of the engines with the throttle wide open, and it will be noted from those curves that with the throttle wide open, the maximum increase in power when using the system of the present invention (Curve A) occurs near the top engine RPM. Other similar comparative tests show that at low throttle settings the maximum increase in power when using the system of the present invention occurs toward the low end of the engine RPM range. These operating characteristics are particularly advantageous in a motorcycle engine, because the arrangement of the invention provides desirable increase in power not only at times of high speed travel of the motorcycle when the engine is running at high RPM, but also at starting times when it is advantageous to rapidly accelerate the motorcycle with low throttle settings.

I claim:

1. Reed valve mechanism for use in a fuel/air supply passage of an internal combustion engine, comprising a V-shaped reed cage with its apex presented downstream of the direction of flow through the supply passage, the reed cage having converging side walls with valve ports therein communicating with the supply passage, the side walls having planar external surfaces meeting along the reed cage apex, and reed valves overlaying the valve ports on the downstream sides of the reed cage planar surfaces, the reed cage further having at least one end wall with an interior surface defining a portion of the supply passage and being of curvilinear aeroform contour with respect to the axis of flow through the supply passage to the valve ports, the curvilinear contour of which is substantially uninterrupted upstream from the valve surface of the reed valve at least to the upstream edges of the reed valve cage, and the upstream portion of said curvilinear aeroform interior surface of said end wall being closer to the flow axis than the downstream portion of said end wall.

2. A reed valve mechanism as defined in claim 1 in which the reed cage further includes an additional wall having a surface presented toward the flow passage in a position opposite to the aeroform surface of said end wall, said additional wall being of aeroform contour with respect to the axis of the flow passage, with the upstream portion of its aeroform surface closer to the flow axis than the downstream portion of the aeroform surface of said additional wall.

3. Reed valve mechanism for use in a fuel/air supply passage of an internal combustion engine, comprising V-shaped reed cage with its apex presented downstream of the direction of flow through the supply passage, the reed cage having converging side walls with valve ports therein communicating with the supply passage, the side walls having planar external surfaces meeting along the reed cage apex, and reed valves overlying the valve ports on the downstream sides of the reed cage planar surfaces, the reed cage further having transverse walls extended between the converging side walls of the reed cage and spaced from each other axially of the reed cage apex, the converging side walls and the transverse walls defining a flow passage communicating with the supply passage and with the valve ports in the converging side walls of the reed cage, the surfaces of said transverse walls at opposite sides of said flow passage being of continuous curvilinear aeroform contour from the valve ports to the upstream edges of the reed cage and having surface portions spaced from each other at different distances in upstream and downstream portions of said flow passage, the spacing distance being smaller in a region upstream of said flow passage as compared with a region downstream of said flow passage.

4. Reed valve mechanism for use in a fuel/air supply passage of an internal combustion engine, comprising a V-shaped reed cage with its apex presented downstream of the direction of flow through the supply passage, the reed cage having planar external converging side walls meeting along the reed cage apex and each having at least one primary valve port therein communicating with the supply passage, and reed valves overlying the valve ports on the downstream sides of the reed cage planar surfaces, the reed valves overlying a valve port including a primary reed having a plurality of secondary valve ports therethrough communicating with a single primary valve port, and the reed valves further including a separate secondary reed for each of said secondary valve ports.

5. Reed valve mechanism for use in a fuel/air supply passage of an internal combustion engine, comprising a V-shaped reed cage with its apex presented downstream of the direction of flow through the supply passage, the reed cage having planar external converging side walls meeting along the reed cage apex and each having at least one primary valve port therein communicating with the supply passage, and reed valves overlying the valve ports on the downstream sides of the reed cage planar surfaces, the reed valves overlying a valve port including a primary reed having a plurality of secondary valve ports therethrough communicating with a single primary valve port, and the reed valves further including a separate secondary reed for each of said secondary valve ports, the reed cage further having transverse walls extended between the converging side walls of the reed cage and defining portions of a flow passage leading from the supply passage to one of said ports, said transverse walls being spaced from each other axially of the reed cage apex, the surfaces of said transverse walls at opposite sides of said flow passage being of aeroform contour and having surface portions spaced from each other at different distances in upstream and downstream portions of said flow passage, the spacing distance being smaller in a region upstream of said flow passage as compared with a region downstream of said flow passage.

6. Reed valve mechanism for use in a fuel/air supply passage of an internal combustion engine, comprising at a passage wall structure having wall surfaces positioned at opposite sides of the axis flow through the supply passage, a wall element positioned transversely of the axis of flow and having a fuel/air supply port therein positioned to pass fuel/air flowing in the direction of said axis flow, and a flexible reed valve overlying said port and connected with said wall element at a side of said port, the flow passage wall structure having side wall areas spaced at opposite sides of the axis of flow at different distances in regions upstream and downstream of the axis flow, the side wall at at least one side of the flow passage being of curved aeroform contour with the curvature beginning substantially contiguously with the plane of contact of the ported wall element with the valve reed and forming curved surfaces extending continuously at least from the side of said port at which the reed valve is connected and in a direction upstream of the flow passage.

7. Reed valve mechanism for use in a fuel/air supply passage of an internal combustion engine, comprising a passage wall structure having wall surfaces positioned at opposite sides of the axis of flow through the supply passage, a ported wall element positioned transversely of the path of flow and having a fuel/air supply port therein positioned to pass fuel/air flowing in the direction of said path of flow, and a flexible reed valve connected with said ported wall element at one side of said port and extended across said port and having a free edge at the side of said port opposite to said one side, the flow passage wall structure having side wall areas spaced at opposite sides of the path of flow, the side wall at the side of the flow passage opposite to said one side being of curved aeroform contour as the region of the free edge of the reed valve is approached, the curved side wall joining the port immediately adjacent the plane of contact of the ported wall element with the valve reed and extending from the juncture with the port in a continuous curve extending lengthwise of the flow passage.

8. Reed valve mechanism for use in a fuel/air supply passage of an internal combustion engine, comprising a passage wall structure having wall surfaces positioned at opposite sides of the axis of flow through the supply passage, a ported wall element positioned transversely of the path of flow and having a fuel/air supply port therein positioned to pass fuel/air flowing in the direction of said path of flow, a primary flexible reed valve connected with said ported wall element at one side of said port and extended across said port and having a free edge at the side of said port opposite to said one side, the flow passage wall structure having side wall areas spaced at opposite sides of the path of flow, the side wall at the side of the flow passage opposite to said one side being of curved aeroform contour as the region of the free edge of the reed valve is approached, said primary reed valve having a plurality of secondary valve ports therethrough communicating with the supply port in the ported wall element, and separate secondary reed valves overlying said secondary valve ports.

9. Reed valve mechanism for use in a fuel/air supply passage of an internal combustion engine, comprising a V-shaped reed cage with its apex presented downstream of the direction of flow through the supply passage, the reed cage having converging side walls with valve ports therein communicating with the supply passage, the side walls having planar external surfaces meeting along the reed cage apex, and reed valves overlying the valve ports on the downstream sides of the reed cage planar surfaces, the reed cage further having transverse walls extended between the converging side walls of the reed cage and spaced from each other axially of the reed cage apex, the converging side walls and the transverse walls defining a flow passage communicating with the supply passage and with the valve ports in the converging side walls of the reed cage, the interior surfaces of the converging side walls of the reed cage having ridges of rounded cross section extended upstream and downstream of the flow passage and thereby providing partially separated curvilinear flow channels in said flow passage upstream of the valve ports, the reed valves including a primary valve reed of width sufficient to overlie said partially separated flow channels.

10. Reed valve mechanism for use in a fuel/air supply passage of an internal combustion engine, comprising a V-shaped reed cage with its apex presented downstream of the direction of flow through the supply passage, the reed cage having converging side walls with valve ports therein communicating with the supply passage, the side walls having planar external surfaces meeting along the reed cage apex, and reed valves overlying the valve ports on the downstream sides of the reed cage planar surfaces, the reed cagefurther having transverse walls extended between the converging side walls of the reed cage and spaced from each other axially of the reed cage apex, the converging side walls and the transverse walls defining a flow passage communicating with the supply passage and with the valve ports in the converging side walls of the reed cage, the interior surfaces of the converging side walls of the reed cage having ridges of rounded cross section extended upstream and downstream of the flow passage and thereby providing partially separated curvilinear flow channels in said flow passage upstream of the valve ports, the reed valves including a primary valve reed of sufficient width to overlie the partially separated flow channels, the primary valve reed having secondary valve ports therein, and the reed valves further including separate secondary valve reeds overlying the secondary valve ports in the primary valve reed.

11. An internal combustion engine comprising:

an engine housing structure having a wall with a fuel/air inlet port and an intake passage, the intake passage having an inlet end adapted to receive fuel/air from a supply source and having an outlet end communicating with said inlet port in the engine housing structure, a V-shaped reed valve cage in the intake passage with the reed cage apex presented downstream of the intake passage, the reed valve cage having interior flow passage means including means for aerodynamically reducing flow velocity fluctuations, the reed cage also having converging external side walls with valve ports therein communicating with the supply source through the interior flow passage means, the side walls having planar external surfaces meeting along the reed cage apex, at least one reed valve overlying the valve ports on each downstream side of each reed cage side wall, each reed valve being connected to the reed cage in the region of the planar surface remote from the reed cage apex to provide for flexing of the valve away from the planar surface in the region adjacent to the reed cage apex, the reed cage having a generally triangular end wall at each end interconnecting the converging side walls of the reed cage with an apex of each triangular end wall adjoining the reed cage apex, and the engine housing structure having means outside of each end wall of the reed cage defining inclined flow passages of curvilinear cross section, said inclined flow passages being extended generally parallel to the planar converging external side walls of the reed cage and having flow axes lying outside of the planes of the planar external surfaces of the converging side walls of the reed cage, said inclined flow passages at each end of the reed cage being interconnected with the inlet port of the engine housing structure, the interior flow passage means of the reed cage having a laterally curved bevelled edge at each end of the reed valve cage adjacent to the adjacent side edge of the valve port, thereby minimizing aerodynamic drag in the flow of the fuel/air laterally from the valve port under the side edge of the valve reed and into the adjoining curvilinear end wall of the reed cage when the valve reed opens.

12. An internal combustion engine as defined in claim 11 and further in which the engine housing structure has triangular planar wall areas congruent with and lying adjacent to the triangular end walls of the reed cage.

13. An internal combustion engine comprising:

an engine housing structure having a wall with a fuel/air inlet port and an intake passage, the intake passage having an inlet end adapted to receive fuel/air from a supply source and having an outlet end communicating with said inlet port in the engine housing structure, a V-shaped reed valve cage in the intake passage with the reed cage apex presented downstream of the intake passage, the reed valve cage having converging side walls with valve ports therein communicating with the supply source, the converging side walls having planar external surfaces meeting along the reed cage apex, at least one reed valve overlying the valve ports on each downstream side of each reed cage side wall, each reed valve being connected to the reed cage in the region of the planar surface remote from the reed cage apex to provide for flexing of the valve away from the planar surface in the region adjacent to the reed cage apex, the reed cage having a generally triangular end wall at each end interconnecting the converging side walls of the reed cage with an apex of each triangular end wall adjoining the reed cage apex, and the engine housing structure having means outside of each end wall of the reed cage defining inclined flow passages of curvilinear cross section, said inclined flow passages being extended generally parallel to the planar converging external side walls of the reed cage and having flow axes lying outside of the planes of the planar external surfaces of the converging side walls of the reed cage, said inclined flow passages at each end of the reed cage being interconnected with the inlet port of the engine housing structure, the interior surface of at least one end wall of the reed cage being of aeroform contour with respect to the axis of flow through the reed cage, the upstream portion of said interior aeroform surface being closer to the flow axis than the downstream portion thereof.

14. An internal combustion engine comprising:

an engine housing structure having a wall with a fuel/air inlet port and an intake passage, the intake passage having an inlet end adapted to receive fuel/air from a supply source and having an outlet end communicating with said inlet port in the engine housing structure, and the engine housing structure further having transfer passages and also having supplemental fuel/air passages interconnecting the intake passage and said transfer passages, a V-shaped reed valve cage in the intake passage of the housing structure and positioned with the reed cage apex presented downstream of the intake passage, the reed valve cage having means defining an interior flow channel and having exterior converging side walls with valve ports therein communicating with the interior flow channel, the exterior converging side walls having planar external surfaces meeting along the reed cage apex, at least one reed valve overlying the valve ports on each downstream side of each reed cage side wall, each reed valve being connected to the reed cage in the region of the planar surface remote from the reed cage apex to provide for flexing of the valve away from the planar surface in the region adjacent to the reed cage apex, thereby opening the valve ports at the downstream ends and at the side edges thereof, the reed cage further having a generally triangular end wall at: each end interconnecting the converging side walls of the reed cage with an apex of the triangular end wall adjoining the reed cage apex and having means defining the adjacent walls of the interior flow channel, the interior surface of at least one end wall of the reed cage being of aeroform contour with respect to the axis of flow through the interior flow channel, the upstream portion of said interior aeroform surface being closer to the flow axis than the downstream portion thereof, and the engine housing structure having means at each end of the reed cage defining inclined flow passages of curvilinear cross section, said inclined flow passages being extended generally parallel to the planar external surfaces of the reed cage walls and having flow axes lying outside of the planes of the planar external surfaces of the converging side walls of the reed cage in the region of the adjacent side edges of the valve ports, said inclined flow passages at each end of the reed cage intercommunicating with each other, with said supplemental passages and with the inlet port of the engine housing structure, and when the overlying valve is open, said inclined flow passages also communicating with the interior flow channel in the reed valve cage through the open downstream ends and the open side edges of the valve ports.

15. A piston and cylinder internal combustion engine comprising:

an engine housing structure having a wall with a fuel/air inlet port below the bottom dead center position of the piston and having an intake passage, the intake passage having an inlet end adapted to receive fuel/air from a supply source and having an outlet end communicating with said inlet port in the engine housing structure below the bottom dead center position of the piston, and the engine housing structure further having transfer passages with inlet ports below the bottom dead center position of the piston, a V-shaped reed valve cage in the intake passage of the housing structure and positioned with the reed cage apex presented downstream of the intake passage at a level in the region of the inlet ports of the transfer passages, the reed valve cage having means defining an interior flow channel and having exterior converging side walls with valve ports therein communicating with the interior flow channel, the exterior converging side walls having planar external surfaces meeting along the reed cage apex, at least one reed valve overlying the valve ports on each downstream side of each reed cage side wall, each reed valve being connected to the reed cage in the region of the planar surface remote from the reed cage apex to provide for flexing of the valve away from the planar surface in the region adjacent to the reed cage apex, thereby opening the valve ports at the downstream ends and at the side edges thereof, the reed cage further having a generally triangular end wall at each end interconnecting the converging side walls of the reed cage with an apex of the triangular end wall adjoining the reed cage apex and having means defining the adjacent walls of the interior flow channel, the interior surface of at least one end wall of the reed cage being of aeroform contour with respect to the axis of flow through the interior flow channel, the upstream portion of said interior aeroform surface being closer to the flow axis than the downstream portion thereof, and the engine housing structure having means at each end of the reed cage defining inclined flow passages of curvilinear cross section, said inclined flow passages being extended generally parallel to the planar external surfaces of the reed cage walls and having flow axes lying outside of the planes of the planar external surfaces of the converging side walls of the reed cage in the region of the adjacent side edges of the valve ports said inclined flow passages at each end of the reed cage intercommunicating with each other and with the inlet port of the engine housing structure below the bottom dead center position of the piston, and when the overlying valve is open, said inclined flow passages also communicating with the interior flow channel in the reed valve cage through the open downstream ends and the open side edges of the valve ports.

16. A piston and cylinder internal combustion engine as defined in claim 15, in which the engine housing structure has transfer passages at each side of the cylinder beyond the ends of the reed cage, in which the reed cage has valve ports with side edges adjacent each end of the reed cage, and further in which the means defining the interior flow channel of the reed cage has a curvilinear laterally bevelled edge adjacent to the side edge of each valve port, thereby minimizing flow velocity fluctuations of the fuel/air laterally from the valve ports under the side edge of the valve reed into the adjoining curvilinear inclined flow passage outside of the adjacent end wall of the reed cage when the valve reed opens.

17. Reed valve mechanism for use in a fuel/air supply passage of an internal combustion engine, comprising a V-shaped reed cage with its apex presented downstream of the direction of flow through the supply passage, the reed cage having an inlet and converging side walls with valve ports and herein communicating with the supply passage, the side walls having planar external surfaces meeting along the hood cage apex, and reed valves connected with the reed cage in the region remote from the apex and overlying the valve ports on the downstream sides of the reed cage planar surfaces, the supply passage having an aeroform passage wall the curvilinear contour of which is substantially uninterrupted from the external valve surface of the reed cage at least in said region remote from the apex of the reed cage, said curvilinear contour of the passage wall extending in the upstream direction of flow to the inlet and the aeroform wall passage having end wall surfaces, the upstream portions of which are closer to the flow axis than the downstream portions.

* * * * *

UNITED STATES PATENT AND TRADEMARK OFFICE

CERTIFICATE OF CORRECTION

PATENT NO. : 4,879,976

DATED : November 14, 1989

INVENTOR(S) : Eyvind Boyesen

It is certified that error appears in the above-identified patent and that said Letters Patent is hereby corrected as shown below:

Column 7, line 46, "crosssectional" should be --cross-sectional--

Column 7, line 59, "invention From" should be --invention. From--

Column 7, line 62, "port 20 The" should be --port 20. The--

Column 14, line 10, delete second "at"

Column 15, line 25, "cagefurther" should be --cage further--

Column 16, line 20, after "curvilinear" add --inclined flow passage outside of the adjacent--

Signed and Sealed this

Twelfth Day of February, 1991

*Attest:*

HARRY F. MANBECK, JR.

*Attesting Officer*

*Commissioner of Patents and Trademarks*